US006702966B1

(12) United States Patent
Suzuki et al.

(10) Patent No.: US 6,702,966 B1
(45) Date of Patent: Mar. 9, 2004

(54) METHOD FOR MANUFACTURING CEMENT FIBER SHEETS

(75) Inventors: Shiniti Suzuki, Mie (JP); Yoshiharu Ookubo, Shiga (JP); Hirosi Watanabe, Mie (JP); Yasusi Sakamoto, Mie (JP); Katunori Akiyama, Mie (JP); Yosuke Tanaka, Mie (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/608,606

(22) Filed: Jun. 30, 2000

(30) Foreign Application Priority Data

Feb. 15, 2000 (JP) ..... 2000-037078

(51) Int. Cl.[7] ..... B28B 5/02; B28B 1/10; B28B 1/52

(52) U.S. Cl. ..... 264/70; 264/87; 264/257; 264/333; 425/85; 425/197; 425/224; 425/371; 425/447; 425/449

(58) Field of Search ..... 264/87, 70, 257, 264/333; 425/85, 371, 197, 223, 224, 447, 449, 141

(56) References Cited

U.S. PATENT DOCUMENTS

| | | | | | |
|---|---|---|---|---|---|
| 2,422,344 | A | * | 6/1947 | Easterberg et al. | 162/122 |
| 2,445,210 | A | * | 7/1948 | Colton | 264/113 |
| 4,242,142 | A | * | 12/1980 | Gee et al. | 106/714 |
| 4,379,729 | A | * | 4/1983 | Cross | 156/243 |
| 4,464,225 | A | | 8/1984 | Bubik et al. | 162/181.6 |
| 4,477,300 | A | * | 10/1984 | Pilgrim | 156/44 |
| 4,626,389 | A | * | 12/1986 | Lempfer et al. | 156/39 |
| 4,680,089 | A | * | 7/1987 | Aral et al. | 162/198 |
| 5,022,963 | A | * | 6/1991 | Porter et al. | 162/116 |
| 5,366,676 | A | * | 11/1994 | Kobayashi | 264/150 |
| 5,466,143 | A | * | 11/1995 | Suzuki et al. | 425/140 |
| 5,632,848 | A | * | 5/1997 | Richards et al. | 156/346 |
| 5,863,387 | A | * | 1/1999 | Graf | 162/216 |

FOREIGN PATENT DOCUMENTS

| | | | | | |
|---|---|---|---|---|---|
| DE | 864374 | | | 1/1953 | |
| DE | 19824604 | C1 | | 12/1999 | |
| JP | 6-206209 | A | * | 7/1994 | B28B/1/52 |
| JP | 9-174527 | A | * | 7/1997 | B28B/1/52 |
| JP | 10-180728 | A | * | 7/1998 | B28B/1/52 |
| JP | 2000-301512 | A | * | 10/2000 | B28B/1/52 |

* cited by examiner

*Primary Examiner*—Michael Colaianni
*Assistant Examiner*—Michael I. Poe
(74) *Attorney, Agent, or Firm*—Greenblum & Bernstein, P.L.C.

(57) ABSTRACT

A method is provided for manufacturing cement fiber sheets by supplying slurry primarily including fibers and cement as main material components onto a permeable sheet, and suctioning and dewatering the slurry. The method includes a foreign matter removing operation for removing foreign matter in the slurry material before supplying it to the permeable sheet, a thickness control operation for bringing the slurry to a specified thickness after the foreign matter removing process, and a leveling operation for smoothing the slurry surface after the thickness control process. Thus, treatment for foreign matter contained in slurry as well as thickness control, is throughly carried out, so that the product surface quality is ensured.

11 Claims, 4 Drawing Sheets

METHOD FOR MANUFACTURING CEMENT FIBER SHEETS

CROSS-REFERENCE TO RELATED APPLICATIONS

The present application claims priority under 35 U.S.C. §119 of Japanese Patent Application No. 2000-037078, filed on Feb. 15, 2000.

BACKGROUND OF THE INVENTION

1. Field of Invention

The present invention relates to a method for manufacturing cement fiber sheets, and more specifically to a technique for manufacturing cement fiber sheets, for example, used for exterior construction material (siding board, roofing tiles, etc.), exterior products (fences, gates, etc.), and interior construction material (floors, walls, ceiling, etc.).

2. Description of Related Art

Conventionally, in manufacturing these types of cement fiber sheets, there is known a construction method for manufacturing cement fiber sheets in which slurry including fiber and cement materials is discharged from a discharging port for controlling the thickness supplied onto permeable sheets, suctioned and dewatered.

However, accumulated foreign matter constantly enters the slurry from, for example, compounding equipment, mixing equipment, piping, pumps, etc., and falling matter also enters. If the foreign matter enters, the foreign matter may directly affect the product appearance and in particular, depending on the size of foreign matter, holes, cracking, or tears may result. In addition, when slurry containing foreign matter passes the discharging port for controlling thickness, fine foreign matter is caught by the discharging port, which results in degradation of product surface quality, and as result, the product does not meet the product thickness standard.

SUMMARY OF THE INVENTION

The present invention has been achieved in view of the problems of the above-mentioned conventional examples, and it is an object of the present invention to provide a method for manufacturing cement fiber sheets which can eliminate foreign matter in the slurry, thereby the thickness can be positively controlled and the product surface quality is ensured.

In the present invention, to solve the problems mentioned above, a method for manufacturing cement fiber sheets is provided in which slurry primarily including fibers and cement as material components is supplied onto a permeable sheet, then suctioned and dewatered. The method also includes a foreign matter removing process for removing foreign matter contained in the slurry material before supplying the slurry to the permeable sheet, a thickness control process for controlling slurry to a specified thickness after the foreign matter removing process, and a leveling process for smoothing the slurry surface after the thickness control process. These processes eliminate detrimental effects of foreign matter on the product appearance and at the same time make it possible to prevent holes, cracking, or breakage in products beforehand by providing a foreign matter removing process, and consequently, the product surface quality is ensured and thickness control is positively implemented.

In addition, the slurry concentration is desirably between 35 and 65%, and in such event, the fluidity of slurry is proper and effects of ensuring the product surface quality, as well as effects of positively implementing thickness control and leveling can be expected, and at the same time, the problem of ease of spilling of slurry can be simultaneously solved.

In implementing the leveling process of the present invention, a leveling device equipped with a smooth-forming pressure plate is desirably used for pressing and smoothing the slurry surface and at the same time, an endless sheet is desirably positioned rotatably between the slurry surface and smooth-forming pressure plate. Thus, it is possible to prevent cracking caused by chafing between the slurry surface and the leveler and at the same time the problem of product surface quality being degraded by the leveler itself can also be eliminated.

In implementing the thickness control process, it is desirable to use a thickness controller provided with a discharging port for discharging slurry to a specified thickness and to use a leveler for imparting vibrating action to the discharging part, and in such event, when slurry is discharged from the discharging port, it is possible to simultaneously control slurry thickness by the discharging port and to smooth the slurry surface by the vibrating action.

According to an aspect of the present invention a method is provided for manufacturing cement fiber sheets in which slurry primarily including fibers and cement as material components is supplied onto a permeable sheet, and then suctioned and dewatered. The method includes removing foreign matter contained in the slurry material before supplying the slurry to the permeable sheets, controlling a thickness of the slurry supplied to the permeable sheet and smoothing the slurry surface after the thickness control process.

According to a further aspect of the present invention, in the method a slurry concentration of between 35 and 65% is used.

Further according to an aspect of the present invention, the leveling operation is carried out by a leveler equipped with a smooth-forming pressure plate for pressing the slurry surface for smoothing, and at the same time an endless sheet is rotatably intervened between the slurry surface and the smooth-forming pressure plate.

Furthermore, according to another aspect of the present invention, in the method, when the thickness control operation is carried out, a thickness controller equipped with a discharge port for discharging slurry to provide a specified thickness and a leveler for providing vibrating action to the discharging port are used.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF PREFERRED EMBODIMENTS

Figure 1:
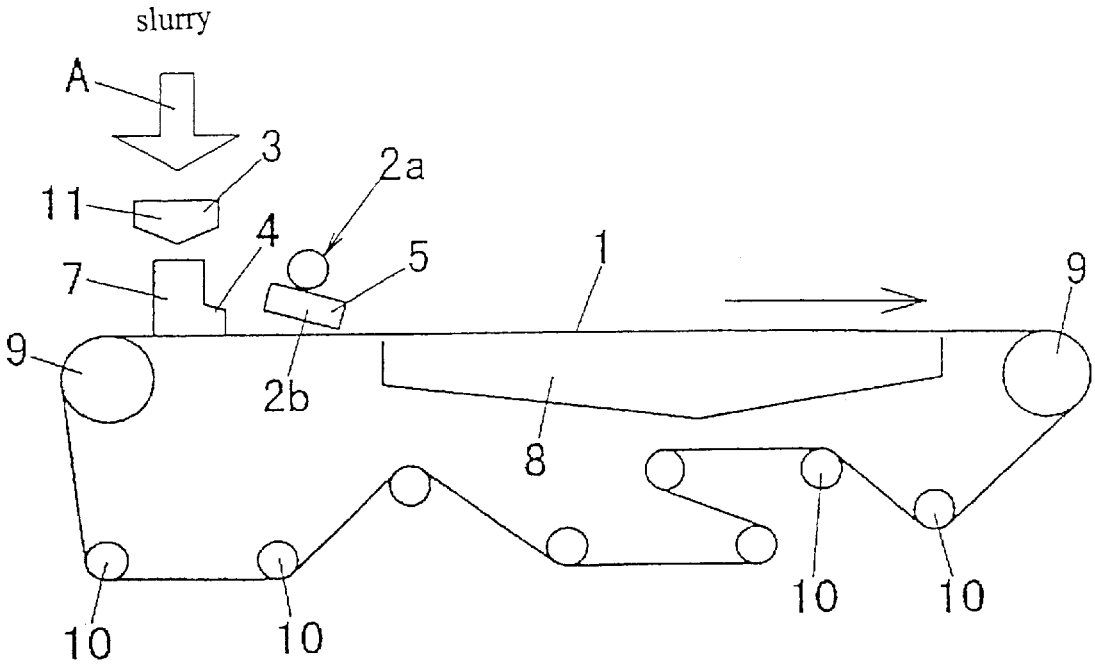
FIG. 1 is a schematic block diagram depicting a first embodiment according to the present invention.

Referring now to the drawings, the present invention will be described in detail hereinafter.

In a first embodiment of the present embodiment, when cement fiber sheets primarily including fibers and cement as main materials are manufactured, the material including fibers and cement is made into a slurry of a proper concentration, and in the slurry state A (as shown in FIG. 1), the material is supplied onto a permeable sheet 1 after passing through a foreign matter removing apparatus 3 and thickness control apparatus 4 shown in FIG. 1, successively. The supplied slurry A is subjected to a vacuum and dewatered by suction to a proper water content or press-dewatered as required after the leveling apparatus 5, and is cured and hardened to products. Curing may be natural curing (wet heat curing) or high-pressure steam curing (autoclave curing). As a way to perform the suction and dewatering, a sheet-form product, after the leveling apparatus 5, is passed on a pressure reducer (or a vacuum source) to adjust the slurry to a specified water content. The permeable sheet may be wrapped around a plurality of driving rollers 9, 10 endlessly, for example, felt or wire (plastic, metal, etc.) may be used, and from the viewpoint of durability, felt and wire may be used together.

The slurry A is formed, for example, by pulp and cement which are dispersed in water. However it is to be understood that the slurry A compounding materials are not intended to be limited to this example. For example, cement and other fibers except pulp, or cement and other powders except silica, etc. may be used. The concentration of slurry A is desirably between about 35 and about 65% (solid weight/total weight). Experiments by the inventor have indicated that although the proper concentration varies in accordance with the slurry composition, generally maintaining a slurry concentration between about 35 and 65% is proper for fluidity of the slurry A and particularly achieve remarkable leveling effects. That is, if the slurry A concentration becomes high so as to exceed 65%, the fluidity is insufficient and consequently, effects of ensuring the product surface quality and effects of positively carrying out thickness control are unable to be expected. If the slurry A concentration is lower than 35%, the slurry A is easy to spill from the discharge port 7*b*, and tends to be put into disorder even during production. It is understood that when the present invention is applied at a low concentration, the thickness is stably controlled by forming a slurry pool by tilting the permeable sheet 1 in front of the discharging port 7*b* (see FIGS. 3A–3B and 6A–6B).

Accordingly, effects of ensuring the product surface quality, as well as effects of positively implementing thickness control and leveling are obtained, because the slurry concentration is between about 35 and about 65%, the fluidity of slurry is proper and at the same time, it is able to simultaneously solve the problem of ease of spilling of slurry from the discharging port.

Figure 2:
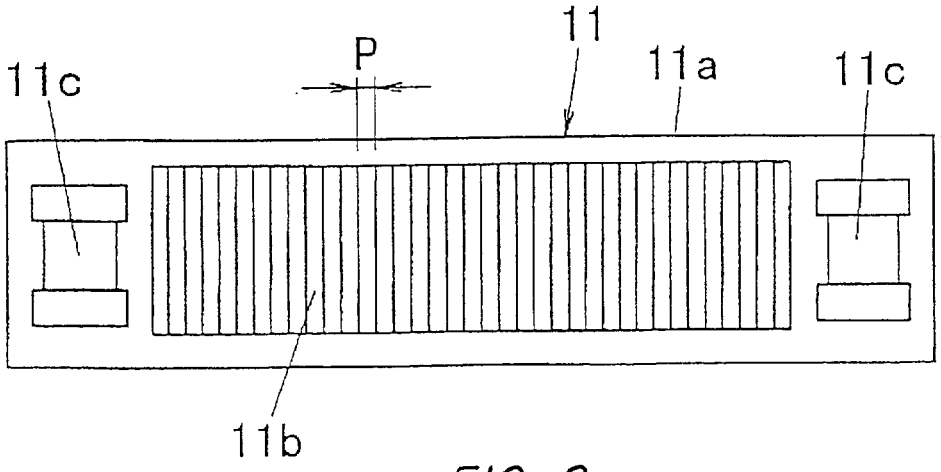
FIG. 2 is a top view of a vibrating screen of the embodiment of FIG. 1.
Figure 3:
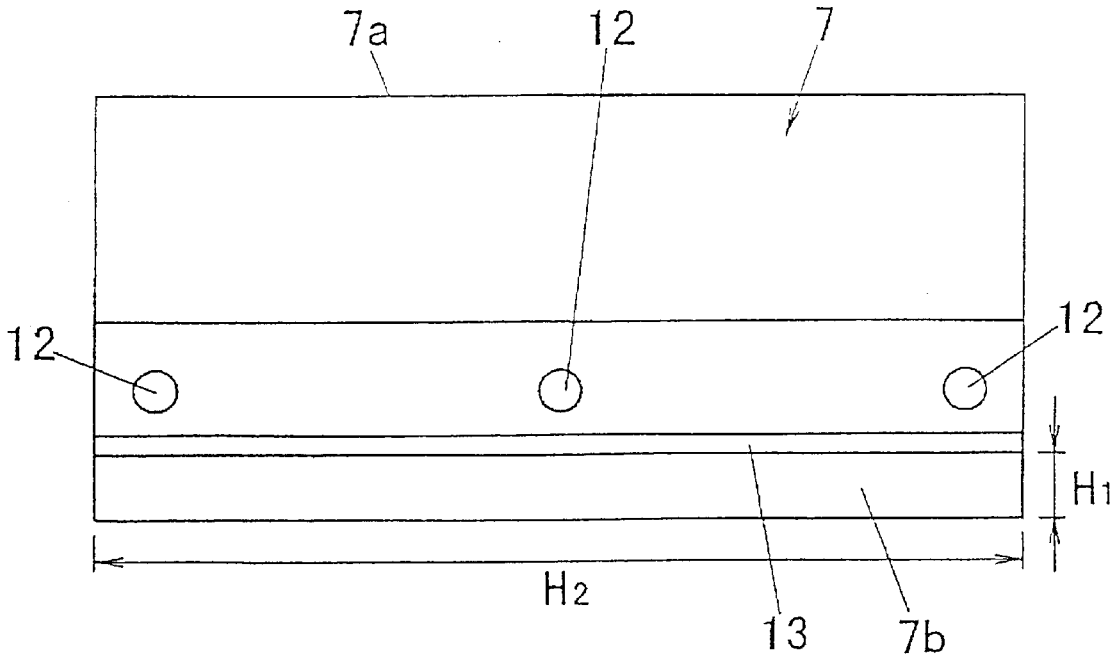
FIG. 3(A) is a front view of a thickness controller.
FIG. 3(B) is a side view of a thickness controller.
Figure 3:
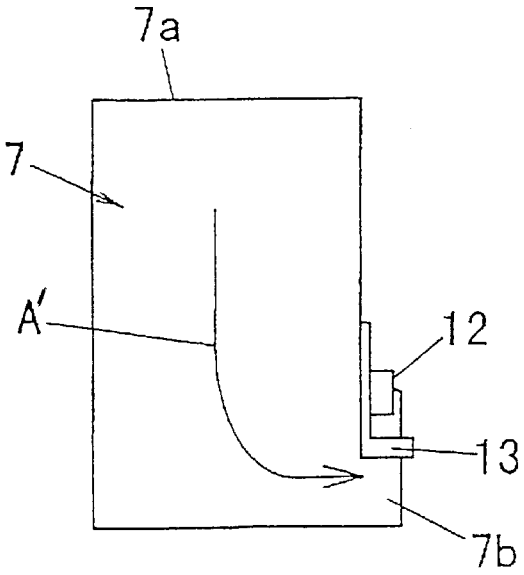

The foreign matter removing apparatus 3 removes foreign matter contained in slurry A in order to form slurry A' without harmful effects due to the foreign matter before dewatering. Furthermore, in the present embodiment, large foreign matter which is unable to pass a clearance of the discharging port 7*b* in the thickness control apparatus 4 is removed in advance by a slit-form foreign matter remover 11. FIG. 2 shows one example of this slit-form remover 11. In this example, a vibrating screen 11*a* with a pair of vibrators 11*c* arranged at both ends of slit-form screen 11*b* is used as the foreign matter remover 11. Thus, by applying vibrating action to the screen 11*b*, foreign matter in slurry A can be sufficiently removed before it is supplied onto the permeable sheet 1. In this case, the minimum opening interval P of screen 11*b* is set to be smaller than the clearance H1 (FIG. 3) of the discharging port 7*b*. By this configuration, even if the opening interval P of the screen 11*b* is small, by vibrating the screen 11*b*, removal of foreign matter in slurry A' is positively carried out, and it is possible to prevent in advance the product surface quality from degrading by the foreign matter caught at the discharging port 7*b* when slurry A' passes through the discharging port 7*b*. In this way, carrying out treatment on foreign matter in the material of cement fiber sheet before suction dewatering device 8 enables positive thickness control and leveling, with the product surface quality ensured.

Next, the thickness control apparatus 4 brings slurry A' to a specified thickness after the foreign matter removing apparatus 3. As shown in FIG. 3(A), a thickness controller 7 having a slurry charging port 7*a* is open at the top, and an elongated discharging port 7*b* is open at the front surface of the lower section. Clearance adjusting plate 13 that can be elevated with adjusting screws 12 is mounted to the top edge of the discharging port 7*b*, and by vertically adjusting the position of the clearance adjusting plate 13, the vertical clearance H1 of the discharging port 7*b* is able to be adjusted. With this device, the thickness dimensions of slurry A' discharged from the discharging port 7*b* can be controlled to a specified thickness. By intentionally varying the opening height of the discharging port 7*b* (clearance H1) with the clearance adjusting plate 13, cement fiber sheets with varying thickness can be manufactured. In addition, by varying the opening width (lateral width H2) of the discharging port 7*b*, it is easy to manufacture cement fiber sheets with varying lateral dimensions.

Figure 4:
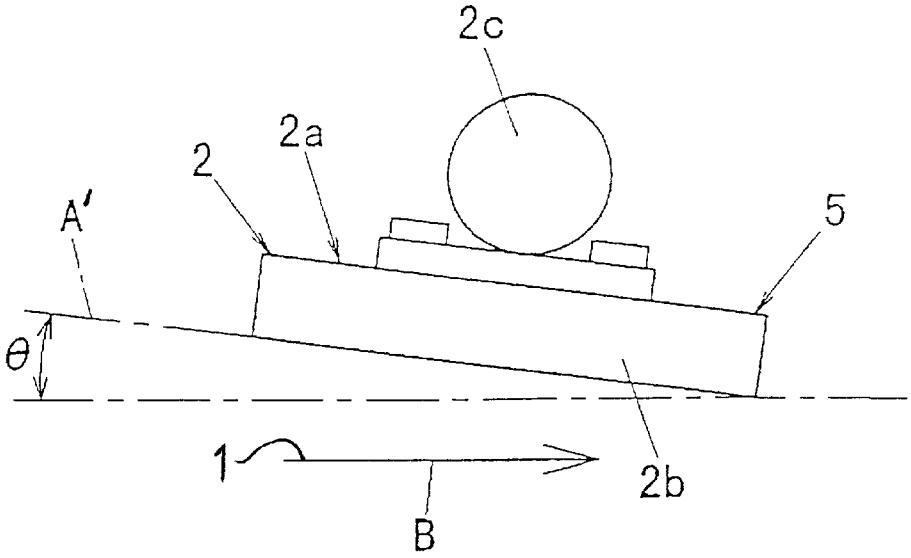
FIG. 4 is a side of a vibrating leveler.

The leveling apparatus 5 is provided for smoothing slurry A' surface after the thickness control apparatus 4, and with this process, slurry A' before dewatering is able to be formed into a sheet with good accuracy free of bad effects of foreign matter. In the present embodiment, as shown in FIG. 4, a vibrating leveler 2*a* is used for a leveler 2. The vibrating leveler 2*a* includes a smooth-forming pressure plate 2*b* for smoothing the surface of slurry A' discharged from the discharging port 7*b* of the thickness controller 7, and a vibrator 2*c* for vibrating the smooth-forming pressure plate 2*b*. The use of this type of vibrating leveler 2*a* enables effective leveling by vibrating leveler 2*a*, and the product surface is able to be further improved.

In the present example, as shown in FIG. 4, the smooth-forming pressure plate 2*b* is tiltable and inclines downwardly in the travel direction B of the permeable sheet 1. The smooth-forming pressure plate 2*b* is set to have an incidence angle θ of slurry A', for example, between about 5 and about 10 degrees, and preferably 7 degrees. If the incidence angle θ is smaller than about 5 degrees, in particular, smaller than about 2 degrees, bubbles generated from products tend to remain on the surface, and if the incidence angle θ is greater than about 10 degrees in particular, when it exceeds about 20 degrees, a tendency to strip off may occur. Further when it exceeds about 30 degrees, thickness frequently tends to be uneven, and the desirable range of the incidence angle θ is assumed to be between about 5 and 10 degrees. In the present embodiment, 7 degrees is shown as one example. However, since the proper value of incidence angle θ varies in accordance with the slurry A concentration, the shape of the vibrating leveler 2*a*, the travel speed of permeable sheet 1, etc., it is necessary to adjust the angle θ due to these various conditions. Furthermore, the number of vibrating levelers 2*a* need not be limited to one but a plurality of units may be provided along the travel direction B of the permeable sheet 1.

Figure 5:
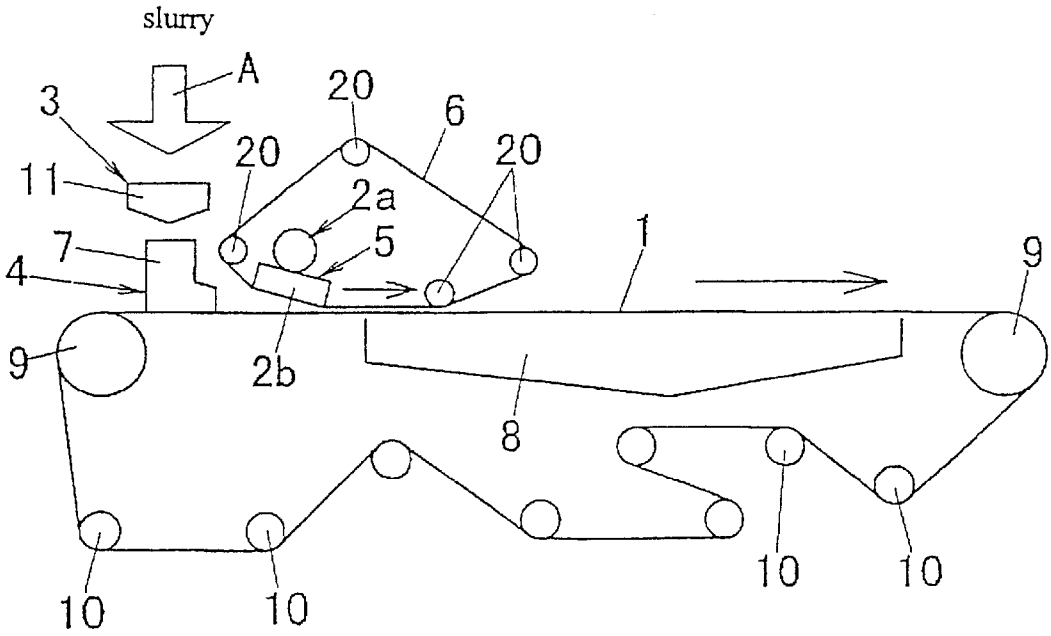
FIG. 5 is a schematic block diagram showing a second embodiment of the present invention.

FIG. 5 shows a case in which an endless sheet 6 is installed between slurry A' and the vibrating leveler 2*a*. The endless sheet 6 includes an endless processed product of plastic mesh so that it is not subject to air bubbles generated at the time of vibrating leveling 5, and particularly, it is effective to introduce the endless sheet 6 when a high level of product surface quality is required. In the present embodiment, the endless sheet 6 is wrapped endlessly around a plurality of rollers 20 arranged to externally surround the vibrating leveler 2*a*. By pressing the smooth-forming pressure plate 2*b* against the slurry A' surface via the rotatable endless sheet 6, chafing does not occur between the smooth-forming pressure plate 2*b* and the slurry A' surface. As a result, breaking of products caused by chafing between the slurry A' surface and the vibrating leveler 2*a* is positively prevented. There is a problem of degrading the product surface quality by the influence of the vibrating leveler 2*a* itself, but installing the endless sheet 6 between the slurry A' surface and the vibrating leveler 2*a*, the above-mentioned problem is able to be solved.

Consequently, the use of endless sheets 6 is effective where still higher levels of product surface quality are required. However, if the higher levels of surface quality are not particularly required, the endless sheet 6 may be omitted.

Figure 6:
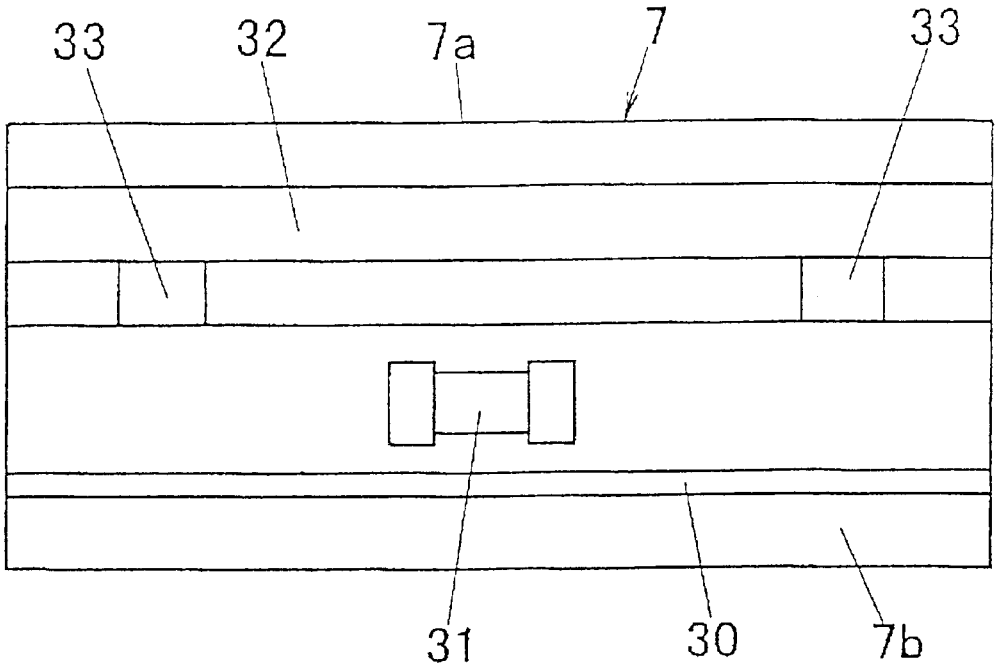
FIG. 6(A) is a front view of a thickness controller of another embodiment of the present invention.
FIG. 6(B) is a side view of a thickness controller.
Figure 6:
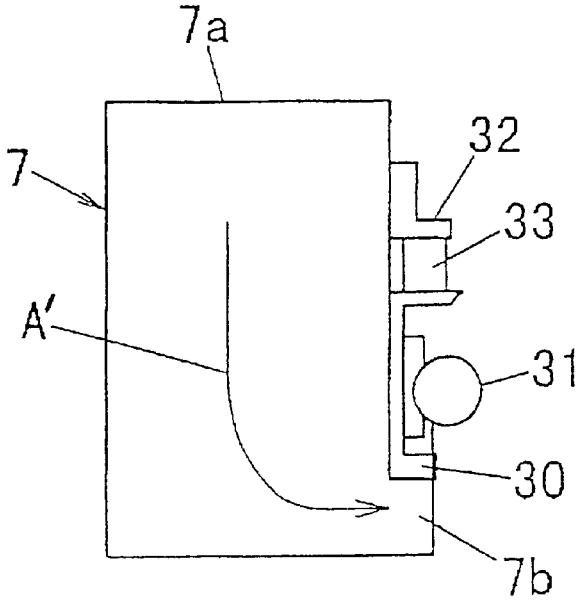

In place of the vibrating leveler 2*a*, for example, vibrating functions may be provided to the discharging port 7*b* of the thickness controller 7, and thickness control and leveling may thus be simultaneously carried out at the discharging port 7*b*. FIG. 6(A) shows one example. In this example, at the upper part of the discharging port 7*b* of the thickness controller, a vibrating plate 30 is mounted, and a vibrator 31 is mounted on vibrating plate 30. The bottom surface of the vibrating plate 30 has a clearance adjusting function. The top surface of the vibrating plate 30 is supported by the cushion retainer 32 mounted on the thickness controller 7 via a rubber cushion 33 so that vibration is not transmitted to the thickness controller 7. The vibrating plate 30 has the function to smooth out the slurry A' surface discharged from the discharging port 7*b* by the vibrating action in addition to the function of controlling the thickness size of slurry A' surface discharged from the discharging port 7*b*. When configured in this way, there is no need to use the vibrating leveler 2*a* at the leveling apparatus 5, and it is possible to achieve an advantage that the leveling process is able to be simplified. Needless to say, the configuration equipped with the discharging port 7*b* having vibrating function of FIGS. 6A and 6B may be combined with the vibrating leveler 2*a* of FIG. 4, and in such event, this becomes still more effective to improve the product quality.

Description will be now made of Examples 1 through 4 of the present invention and Comparisons 1 through 3. Table 1 shows the results of Examples 1 through 4, while Table 2 shows the results of Comparison 1 through 3.

EXAMPLE 1

In the material compounding process, 5% pulp, such as Needle-leaved bleached Kraft pulp (NBKP), 50% cement, such as ordinary portland cement (OPC), and 45% silica powders were dispersed in water to make 25% (solid weight/total weight) slurry. In the foreign matter removing apparatus 3, a slit form vibrating screen 11*a* (FIG. 2) was used. In this event, slit aperture (or minimum opening) interval P was set to 7 mm, and two units of vibrator 2*c* (150 W, 60 Hz) were used. The slurry after it was allowed to pass through the vibrating screen 11*a*, was charged into a thickness controller 7 (FIGS. 3A and 3B) with a 10 mm vertical clearance H1 (horizontal opening width H2: about 1000 mm) of the discharging port 7*b*, the slurry A' discharged from the discharge port 7*b* is supplied onto the permeable sheet 1, and thereafter, it underwent the leveling process 5 to form a sheet. In the leveling process 5, a leveler 2*a* (vibrator 2*c*: 150 W, 60 Hz; press-down pressure: 12 kg was used. In addition, a smooth forming pressure plate 2*b* that served as vibrating plate is tilted so that the incidence angle θ of slurry A' is 7 degrees. The width of the smooth-forming pressure plate 2*b* was set to 1000 mm and the length (flow direction) to 350 mm.

Thereafter, the sheet-form product that passed the vibrating leveler 2*a* was allowed to pass the pressure reducing device or suction device 8 (FIG. 1), thereby adjusting to a specified water content. In this event, the travel speed B of the permeable sheet 1 was set to 20 m/min (meter/minute) and the pressure reducing device 8 to 5 m in total length, and 34 Kpa in pressure reduction degree was used. The water content after dewatering was 28% (water volume/total weight).

In the present example 1, after dewatering, the sheet product was further press-dewatered, and after wet-heat curing, autoclave curing was carried out. Press-dewatering was carried out at 9.8 Mpa pressure for 2 seconds. Wet heat curing was carried out at 60° C. in saturated steam for 48 hours. Autoclave curing was carried out at 180° C. for 6 hours.

EXAMPLE 2

In Example 1 above, the slurry concentration was set to 40% or 60%.

EXAMPLE 3

In Example 1, an endless sheet 6 was rotatably installed between slurry A' and vibrating leveler 2*a* (FIG. 5). For the endless sheet 6, a plastic mesh endless processed sheet was used to prevent influence of air bubbles generated at the time of vibration leveling apparatus 5. For the endless sheet 6, a sheet 1.1 mm in mesh thickness, plain woven and aperture intervals of 1.44 mm was used.

EXAMPLE 4

In Example 1 above, in place of the vibrating leveling 2*a* of FIG. 4, a vibrating plate 30 and a vibrator 31 are mounted on the discharging port 7*b* of the thickness controller 7 shown in FIGS. 6A and 6B to provide leveling functions by vibrating action to the discharging port 7*b*. The example was constructed in such a manner to prevent vibration from being transmitted to the thickness controller 7 by rubber cushion 33. The vibrator 31 of 75 W and 60 Hz was used.

Therefore, it is possible to develop the efficiency of the system and at the same time to simplify the leveling process because when slurry is discharged from the discharging port 7*b*, slurry thickness control and slurry surface smoothing are accomplished by the discharging port 7*b* for controlling slurry thickness and a vibrating plate 30 and a vibrator 31 for making the vibrating action in implementing the thickness control process.

Comparison 1

In Example 1, the thickness controlling process was omitted.

Comparison 2

In Example 1, the leveling process was omitted.

Comparison 3

In Example 1, the slurry concentration was set to 70% or higher.

The results of Examples 1 through 4 and of Comparisons 1 through 3 are shown in Table(s) 1 and 2 below. In the following Tables 1 and 2, "⊙", "○", "Δ" and "X" respectfully represent "very good", "good", "satisfied" and "not good."

TABLE 1

| | Example 1 | Example 2 | | Example 3 | Example 4 |
|---|---|---|---|---|---|
| (Test conditions) Slurry Concentration | 25% | 40% | 60% | 25% | 25% |
| Foreign matter removal | performed | performed | performed | performed | performed |
| Thickness Control | performed | performed | performed | performed | performed with leveling function |
| Vibration leveling | performed | performed | performed | performed equipped with endless sheet | equipped to discharge port |
| (Process condition) Slurry fluidity condition | ○ | ○ | ○ | ○ | ○ |
| Product Surface quality | ○ | ○ | ○ | ⊙ | Δ |
| Thickness control accuracy | ○ ± 1.2% | ○ ± 0.7% | ○ ± 0.8% | ○ ± 0.6% | ○ ± 1.5% |
| (Product quality) Appearance | ○ | ○ | ○ | ⊙ | Δ |
| Flexural strength | ○ 18 Mpa | ○ 19 Mpa | ○ 19 Mpa | ○ 18 Mpa | ○ 18 Mpa |
| Absolute dry Specific Gravity | ○ 1.58 | ○ 1.59 | ○ 1.62 | ○ 1.57 | ○ 1.58 |
| Overall rating | ○ | ○ | ○ | ⊙ | Δ |

TABLE 2

| | Comparison 1 | Comparison 2 | Comparison 3 |
|---|---|---|---|
| (Test conditions) Slurry concentration | 25% | 25% | 70% |
| Foreign matter removal | performed | performed | performed |
| Thickness control | Not performed | performed | performed |
| Vibration leveling | performed | Not performed | performed |
| (Process condition) Slurry fluidity condition | ○ | ○ | Δ (partly retained) |
| Product surface quality | ○ | X (breakage) | X (crack) |
| Thickness control accuracy | ○ ± 14.3% | Immeasurable | Immeasurable |
| (Product quality) Appearance | ○ | X | X |
| Flexural strength | X 12 Mpa | X 13 Mpa | X 15 Mpa |
| Absolute dry specific gravity | X 1.39 | ○ 1.56 | ○ 1.58 |
| Overall rating | X | X | X |

In Table 2, the comparison, in case that the foreign matter removing process 3 was omitted is not shown, but if the foreign matter removing process 3 is not installed, problems shown in conventional cases apparently occur, and if aperture of minimum opening intervals P (FIG. 2) of the vibrating screen 11*a* used in the foreign matter removing process 3 are coarse, it is needless to say that the problem of the discharging port 7*b* of the thickness controller 7 being clogged by foreign matter in the slurry A' certainly occurs.

As described above, it is possible to eliminate detrimental effects of foreign matter on the product appearance and at the same time it is possible to prevent holes, cracking, of breakage in products beforehand by providing a foreign matter removing process, and consequently, the product surface quality is able to be ensured and thickness control is able to be positively implemented.

It is noted that the foregoing examples have been provided merely for the purpose of explanation and are in no way to be construed as limiting of the present invention.

While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method for manufacturing cement fiber sheets in which a slurry including fibers and cement as material components is supplied onto a permeable sheet and then, suctioned and dewatered, comprising;

removing foreign matter contained in the slurry material before supplying the slurry to the permeable sheet;

controlling a thickness of the slurry supplied to the permeable sheet, wherein said controlling is carried out with a thickness controller equipped with a discharge port for discharging slurry to provide a specified thickness and wherein a first leveler is utilized for providing vibrating action to the discharging port; and leveling and smoothing the slurry surface after the controlling, wherein said leveling and smoothing is carried out with a second leveler arranged downstream from the first leveler.

2. The method for manufacturing cement fiber sheets according to claim 1, further comprising providing a slurry concentration of between 35 and 65%.

3. The method for manufacturing cement fiber sheets according to claim 1 wherein said second leveler is equipped with a smooth-forming pressure plate for pressing the slurry surface for smoothing, and at the same time an endless sheet is rotatably intervened between the slurry surface and the smooth-fonrming pressure plate.

4. A method of making a cement fiber sheet in which slurry is supplied onto a permeable sheet, the method comprising:

removing with a foreign matter remover foreign matter from the slurry, the foreign matter remover including a slit-form screen and a vibrator connected to the screen;

controlling a thickness of the slurry with a thickness controller having a slurry charging port provided downstream with respect to the foreign matter remover to receive the slurry from the slit-form screen and a discharging port having a clearance, wherein a first leveler is utilized for providing vibrating action to the discharging port; and leveling and smoothing the slurry surface after the controlling, wherein said leveling and smoothing is carried out with a second leveler arranged downstream from the first leveler, wherein the foreign matter remover is arranged above and separated from the thickness controller.

5. The method of claim 4, wherein the thickness controller further includes a clearance adjusting plate provided to adjust the clearance.

6. The method of claim 5, wherein the clearance adjusting plate includes at least one adjusting screw to elevate the clearance adjusting plate, whereby a clearance of the discharging port is adjusted by vertically adjusting a position of clearance adjusting plate.

7. The method of claim 4, wherein the second leveler includes a pressure plate and a vibrator.

8. The method of claim 7, wherein the pressure plate inclines downward in a travel direction of the permeable sheet.

9. The method of claim 8, wherein the pressure plate is set to have an incidence angle θ relative the slurry.

10. The method of claim 9, wherein the incidence angle is between about 5 and 10 degrees.

11. A method of manufacturing a cement fiber sheet in a device that includes a thickness controller having a slurry charging port and a slurry discharging port, a vibrating plate having a bottom surface and a top surface, the bottom surface being located so as to adjustably cover the discharging port whereby the bottom surface has a clearance adjusting function, a vibrator mounted on the vibrating plate, a cushion retainer mounted on the thickness controller, and a cushion attached between the cushion retainer and the top surface of the vibrating plate, so that vibration is isolated from the thickness controller, the method comprising:

conveying the slurry to the thickness controller;

controlling a thickness of the slurry; and forming the cement fiber sheet.

* * * * *